US011460238B2

(12) United States Patent
Choi et al.

(10) Patent No.: US 11,460,238 B2
(45) Date of Patent: Oct. 4, 2022

(54) REFRIGERATOR

(71) Applicant: SAMSUNG ELECTRONICS CO., LTD., Suwon-si (KR)

(72) Inventors: Nam Gu Choi, Suwon-si (KR); Sun Gyou Lee, Suwon-si (KR); Sang Chul Ryu, Suwon-si (KR); Sang Gyu Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/053,977

(22) PCT Filed: May 7, 2019

(86) PCT No.: PCT/KR2019/005424
§ 371 (c)(1),
(2) Date: Nov. 9, 2020

(87) PCT Pub. No.: WO2019/221435
PCT Pub. Date: Nov. 21, 2019

(65) Prior Publication Data

US 2021/0364220 A1 Nov. 25, 2021

(30) Foreign Application Priority Data

May 16, 2018 (KR) ..... 10-2018-0056133

(51) Int. Cl.
*F25D 23/02* (2006.01)
*E05F 1/12* (2006.01)
*F25D 23/08* (2006.01)

(52) U.S. Cl.
CPC ..... *F25D 23/028* (2013.01); *E05F 1/12* (2013.01); *F25D 23/087* (2013.01);
(Continued)

(58) Field of Classification Search
CPC .. F25D 23/02; F25D 23/028; F25D 2323/021; F25D 2323/024; F25D 2400/06;
(Continued)

(56) References Cited

U.S. PATENT DOCUMENTS 5,694,789 A 12/1997 Do
7,008,032 B2 * 3/2006 Chekal ..... F25D 11/02 312/405

(Continued)

FOREIGN PATENT DOCUMENTS

CN 102679663 A 9/2012
JP 2-122191 5/1990

(Continued)

OTHER PUBLICATIONS

International Search Report dated Aug. 2, 2019 from International Application No. PCT/KR2019/005424, 7 pages.

(Continued)

*Primary Examiner* — Hiwot E Tefera
(74) *Attorney, Agent, or Firm* — Staas & Halsey LLP

(57) ABSTRACT

Provided is a refrigerator having a simplified interior. The refrigerator includes a main body, a storage compartment formed in the main body and having a front side thereof open, a first door rotatably coupled to the main body to open and close a part of the storage compartment, a second door arranged below the first door and rotatably coupled to the main body to open and close a remaining part of the storage compartment, a filler rotatably provided on the first door or the second door to seal a gap between the first door and the second door in a state in which the first door and the second door are closed, a filler guide configured to guide the filler to be rotated in a first direction, and disposed on a sidewall of the storage compartment adjacent to a rotation axis of the first door and the second door, and a filler pusher configured (Continued)

to push the filler to be rotated in a second direction opposite to the first direction.

12 Claims, 18 Drawing Sheets

(52) U.S. Cl.
CPC ..... *E05Y 2900/31* (2013.01); *F25D 2323/021* (2013.01); *F25D 2323/024* (2013.01); *F25D 2400/06* (2013.01)

(58) Field of Classification Search
CPC .. F25D 23/069; F25D 23/087; F25D 2400/04; F25D 23/021; E05F 1/12; E05Y 2900/31; E06B 7/16
See application file for complete search history.

(56) References Cited

U.S. PATENT DOCUMENTS

| | | | | |
|---|---|---|---|---|
| 9,127,876 | B2 * | 9/2015 | Wilson | F25D 23/02 |
| 9,163,870 | B2 * | 10/2015 | Jeon | F25D 23/02 |
| 9,739,524 | B2 * | 8/2017 | Giacomini | F25D 23/04 |
| 10,458,698 | B2 * | 10/2019 | Ham | F25D 23/087 |
| 2012/0235551 | A1 | 9/2012 | Park et al. | |
| 2014/0375198 | A1 * | 12/2014 | Jeon | F25D 23/02 312/404 |
| 2016/0003521 | A1 | 1/2016 | Jeon et al. | |
| 2017/0176094 | A1 | 6/2017 | Giacomini et al. | |
| 2017/0307283 | A1 * | 10/2017 | Giacomini | F25D 23/04 |
| 2018/0142945 | A1 * | 5/2018 | Bodine | E05B 65/0042 |

FOREIGN PATENT DOCUMENTS

| | | |
|---|---|---|
| JP | 9-152261 | 6/1997 |
| JP | 3545152 | 7/2004 |
| KR | 1998-045995 | 9/1998 |
| KR | 10-2012-0106098 | 9/2012 |
| KR | 10-2013-0105065 | 9/2013 |
| KR | 10-2014-0147970 | 12/2014 |
| KR | 10-2016-0073598 | 6/2016 |

OTHER PUBLICATIONS

Chinese Office Action dated Aug. 11, 2021 in Chinese Application No. 201980032248.7; 8pp, 11pp English translation.
Extended European Search Report dated Apr. 26, 2021 from European Application No. 19802846.6.

* cited by examiner

REFRIGERATOR

TECHNICAL FIELD

The disclosure relates to a refrigerator having a pair of rotating doors for opening and closing a storage compartment.

BACKGROUND ART

A refrigerator is a home appliance that includes a main body having a storage compartment, a cold air supply device provided to supply cold air to the storage compartment, and a door provided to open and close the storage compartment and stores food fresh.

The storage compartment has a front side thereof open so that food is put in and out therethrough, and the open front side may be opened and closed by doors. In this case, a separate horizontal partition may not be provided inside the storage compartment so that the storage space of the storage compartment is maximally ensured, and the storage compartment may be opened and closed by a pair of doors that are hinged to upper and lower portions at each side of the refrigerator.

In this case, one of the pair of doors may be provided with a filler for sealing a gap between the pair of doors that may be formed when the pair of doors are in a closed state.

The refrigerator may include a filler guide that guides the filler to rotate when the door provided with the filler is being closed.

The filler guide may be installed on an inner wall of the storage compartment. Conventionally, when a sidewall adjacent to a door hinge between both sidewalls of a storage compartment is referred to as a first sidewall and the other sidewall is referred to as a second sidewall, a filler guide is installed on the second sidewall.

Since the second sidewall is a sidewall first visible to the user when opening the door, it is preferable not to dispose components on the second sidewall so that the interior of the storage compartment is simplified.

Conventionally, the filler guide is installed on the second sidewall, and thus the aesthetic quality of the interior of the storage compartment may be impaired.

DISCLOSURE

Technical Problem

One aspect of the disclosure provides a refrigerator having a pair of rotating doors for opening and closing a storage compartment and a filler configured to seal a gap between the pair of rotating doors, in which a filler guide for guiding the filler is disposed on a sidewall of the storage compartment adjacent to a door hinge, so that the interior of the storage compartment may be simplified.

Another aspect of the disclosure provides a refrigerator that allows a filler to rotate even when a door having no filler is opened, so that items inside a storage compartment may be easily withdrawn.

Technical Solution

According to an aspect of the disclosure, there is provided a refrigerator including: a main body; a storage compartment formed in the main body and having a front side thereof open; a first door rotatably coupled to the main body to open and close a part of the storage compartment; a second door arranged below the first door and rotatably coupled to the main body to open and close a remaining part of the storage compartment; a filler rotatably provided on the first door or the second door to seal a gap between the first door and the second door in a state in which the first door and the second door are closed; a filler guide configured to guide the filler to be rotated in a first direction, and disposed on a sidewall of the storage compartment adjacent to a rotation axis of the first door and the second door; and a filler pusher configured to push the filler to be rotated in a second direction opposite to the first direction.

The filler guide may be configured to guide the filler when the first door or the second door is opened, and the filler pusher may be configured to guide the filler when the first door or the second door is closed.

The refrigerator may further include a hinge arranged between the first door and the second door and rotatably support each of a lower end of the first door and an upper end of the second door, wherein the filler pusher may extend from the hinge.

In a state in which the first door or the second door is closed, the filler guide may be configured to come in contact with the filler to prevent the filler from rotating in the first direction.

The filler may include a first sliding surface formed at a side end thereof and a second sliding surface adjacent to the first sliding surface.

The filler guide may include a first guide surface and a second guide surface configured to guide the first sliding surface and the second sliding surface, respectively, when the first door or the second door is closed.

The first sliding surface, the second sliding surface, the first guide surface, and the second guide surface each may have a curved shape.

The refrigerator may further include: a first cam member arranged on a rotation axis of the filler; a second cam member provided on the first door or the second door to correspond to the first cam member; and an elastic member configured to provide the first cam member or the second cam member with an elastic force such that the first cam member comes in contact with the second cam member.

The filler may be rotated in the first direction or the second direction in response to receiving a force exceeding the elastic force.

The filler guide may be configured to, when the first door and the second door are closed, be located in a first position where the filler is prevented from rotating in the first direction, and when the first door or the second door, which is provided with the filler, is opened, be moved to a second position different from the first position where the filler is allowed to rotate in the first direction.

The filler guide may include a guide portion configured to guide the filler, and a switch portion configured to protrude inward of the storage compartment alone or together with the guide portion.

The filler guide may further include: a shaft portion connected to the guide portion and the switch portion, and forming a rotating center of the guide portion and the switch portion; and an elastic member configured to elastically bias the shaft portion to be rotated in a predetermined direction.

The storage compartment may include a first storage compartment and a second storage compartment laterally divided by a vertical partition.

Advantageous Effects

As is apparent from the above, since the filler guide for guiding the filler is disposed on the sidewall of the storage compartment adjacent to the door hinge, the interior of the storage compartment can be simplified.

Since the filler rotates even when a door having no filler is opened, items inside the storage compartment can be easily withdrawn.

MODES OF THE DISCLOSURE

The embodiments set forth herein and illustrated in the configuration of the disclosure are only the most preferred embodiments and are not representative of the full the technical aspect of the disclosure, so it should be understood that they may be replaced with various equivalents and modifications at the time of the disclosure. In addition, terms used herein are used to aid in the explanation and understanding of the disclosure and are not intended to restrict and/or limit the scope and aspect of the disclosure. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

It should be understood that, although the terms "first," "second," etc. may be used herein to describe various elements, these elements are not limited by these terms. These terms are only used to distinguish one element from another. For example, a first element could be termed a second element, and, similarly, a second element could also be termed a first element, without departing from the scope of the disclosure.

Hereinafter, embodiments according to the disclosure will be described in detail with reference to the accompanying drawings.

Figure 1:
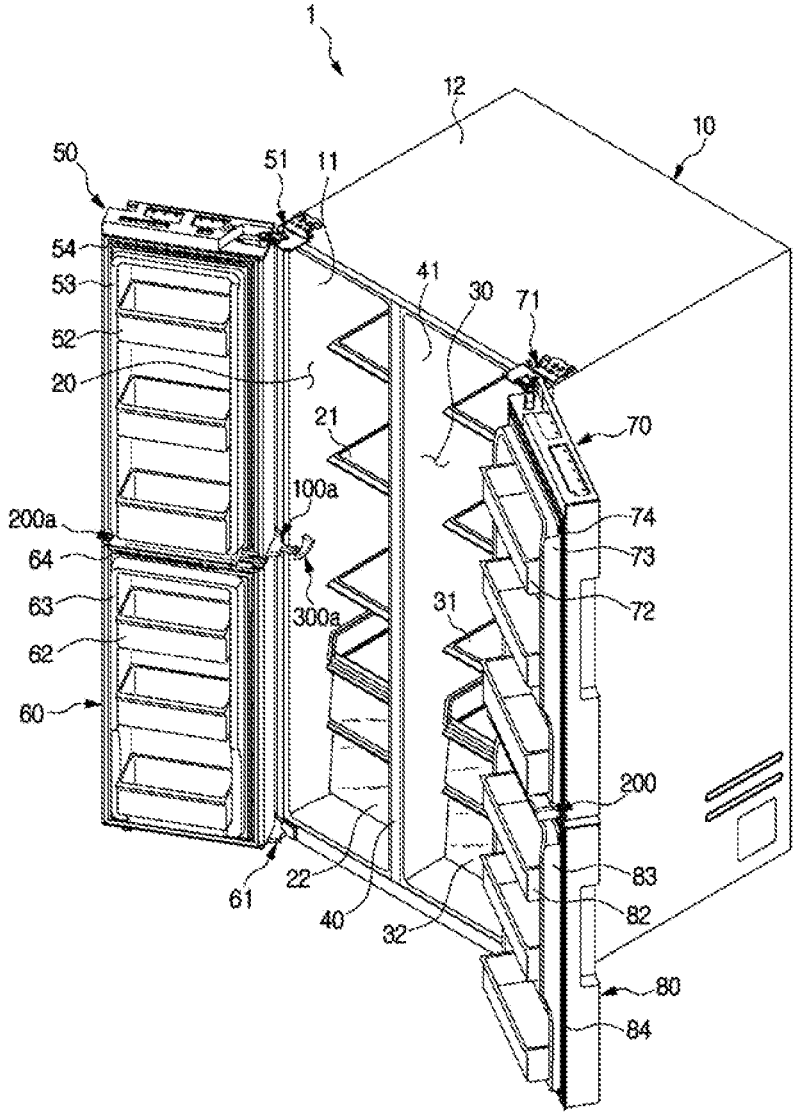
FIG. 1 is a perspective view illustrating a refrigerator according to an embodiment of the disclosure, which shows a state in which doors are in an open state.

FIG. 1 is a perspective view illustrating a refrigerator according to an embodiment of the disclosure, which shows a state in which doors are in an open state.

Referring to FIG. 1, a refrigerator 1 may include a main body 10, storage compartments 20 and 30 formed inside the main body 10, and a cold air supply device (not shown) that supplies cool air to the storage compartments 20 and 30. The storage compartments 20 and 30 may include a first storage compartment 20 and a second storage compartment 30 laterally divided from each other.

The main body 10 may include an inner case 11 forming the storage compartments 20 and 30, an outer case 12 coupled to the outer side of the inner case 11 to form the external appearance thereof, and an insulation (not shown) disposed between the inner case 11 and the outer case 12 to insulate the storage compartments 20 and 30.

The inner case 11 may be formed of a resin material, and the outer case 12 may be formed of a metal material to have durability and aesthetics. The insulation may be provided using urethane, and after coupling the inner case 11 to the outer case 12, a urethane foam solution may be injected between the inner case 11 and the outer case 12 and be foamed and cured.

In another aspect, the main body 10 may include an upper wall, a bottom wall, both sidewalls, a rear wall, and an intermediate wall 40. The intermediate wall 40 may divide the first storage compartment 20 from the second storage compartment 30. The intermediate wall 40 may laterally divide the first storage compartment 20 from the second storage compartment 30. An insulation for insulating the first storage compartment 20 and the second storage compartment 30 may be included inside the intermediate wall 40.

Each of the storage compartments 20 and 30 may be respectively used as a freezer compartment for keeping food frozen at a temperature of about −20° C., and a refrigeration compartment for keeping food refrigerated at a temperature of about 0° C. to 3° C.

The storage compartments 20 and 30 are provided with front sides thereof open such that food are put in or withdrawn, and the open front sides may be opened and closed by doors 50, 60, 70, and 80. The first storage compartment 20 may be opened and closed by a pair of doors 50 and 60, and the second storage compartment 30 may be opened and closed by a pair of doors 70 and 80. Unlike shown in the drawings, one of the first storage compartment 20 and the second storage compartment 30 may be opened or closed by a single door.

The storage compartments 20 and 30 include shelves 21 and 31 allowing food to be placed thereon and sealed boxes 22 and 32 configured to store fish or vegetables in a sealed state.

The doors 50, 60, 70, and 80 may include a first door 50, a second door 60, a third door 70, and a fourth door 80. The first door 50 and the second door 60 may open and close the first storage compartment 20, and the third door 70 and the fourth door 80 may open and close the second storage compartment 30.

The first door 50 may be hingedly coupled to the main body 10 by a first upper hinge 51 and a first intermediate hinge 100*a*. The second door 60 may be hingedly coupled to the main body 10 by the first intermediate hinge 100*a* and a first lower hinge 61. The third door 70 may be hingedly coupled to the main body 10 by a second upper hinge 71 and a second intermediate hinge 100. The fourth door 80 may be hingedly coupled to the main body 10 by the second intermediate hinge 100 and a second lower hinge (not shown).

The upper hinge 51 or 71 and the intermediate hinge 100*a* or 100 may be respectively coupled to an upper portion and a lower portion of one side of the first door 50 or the third door 70 with respect to a central surface area of the first door 50 or the third door 70. The intermediate hinge 100*a* or 100 and the lower hinge 61 (not shown) may be respectively coupled to an upper portion and a lower portion of one side of the second door 60 or the fourth door 80 with respect to a central surface area of the second door 60 or the fourth door 80.

Therefore, the door 50, 60, 70, and 80 may be rotated about a rotation axis (L in FIG. 4) formed at one side with respect to the central surface area thereof, and may be supported by the upper hinge 51 or 71, the lower hinge 61, or the intermediate hinge 100*a* or 100.

Door pockets 52, 62, 72, and 82 to store food may be mounted on the rear surfaces of the doors 50, 60, 70, and 80. Specifically, the door pockets 52, 62, 72, and 82 may be mounted on dykes 53, 63, 73, and 83 protruding from the rear surfaces of the doors 50, 60, 70, and 80.

Gaskets 54, 64, 74, and 84 to seal between the doors 50, 60, 70, and 80 and the main body may be installed at the edges of the rear surfaces of the doors 50, 60, 70, and 80. The gaskets 54, 64, 74, and 84 may be formed of a soft material such as rubber, and may be provided inside with a magnet (not shown).

Meanwhile, as shown in FIG. 1, separate horizontal partitions are not provided in the storage compartments 20 and 30, so that the internal space may be maximally ensured. In addition, one of the pair of doors 50 and 60 that open and close the first storage compartment 20 may be provided with a filler 200*a* to seal a gap between the pair of doors 50 and 60 in a state in which the pair of doors 50 and 60 are closed. Similarly, one of the pair of doors 70 and 80 that open and close the second storage compartment 30 may be provided with a filler 200 to seal a gap between the pair of doors 70 and 80 in a state in which the pair of doors 70 and 80 are closed.

On sidewalls of the storage compartments 20 and 30, filler guides 300*a* and 300 may be provided to guide the fillers 200*a* and 200 to be rotated when the first door 50 or the third door 70 is closed.

In the embodiment of the disclosure, as shown in FIG. 1, the fillers 200*a* and 200 are installed at the lower ends of the upper doors 50 and 70, but the disclosure is not limited thereto and the fillers 200*a* and 200 may also be installed at the upper ends of the lower doors 60 and 80.

Meanwhile, the filler 200*a* rotatably provided on the first door 50 and the filler 200 rotatably coupled to the third door 70 may have the same structure. Therefore, hereinafter, the filler 200 coupled to the third door 70 will be described as an example. In the following description, the upper door and the lower door may refer to the third door 70 and the fourth door 80, respectively, and the storage compartment may refer to the second storage compartment 30.

Figure 2:
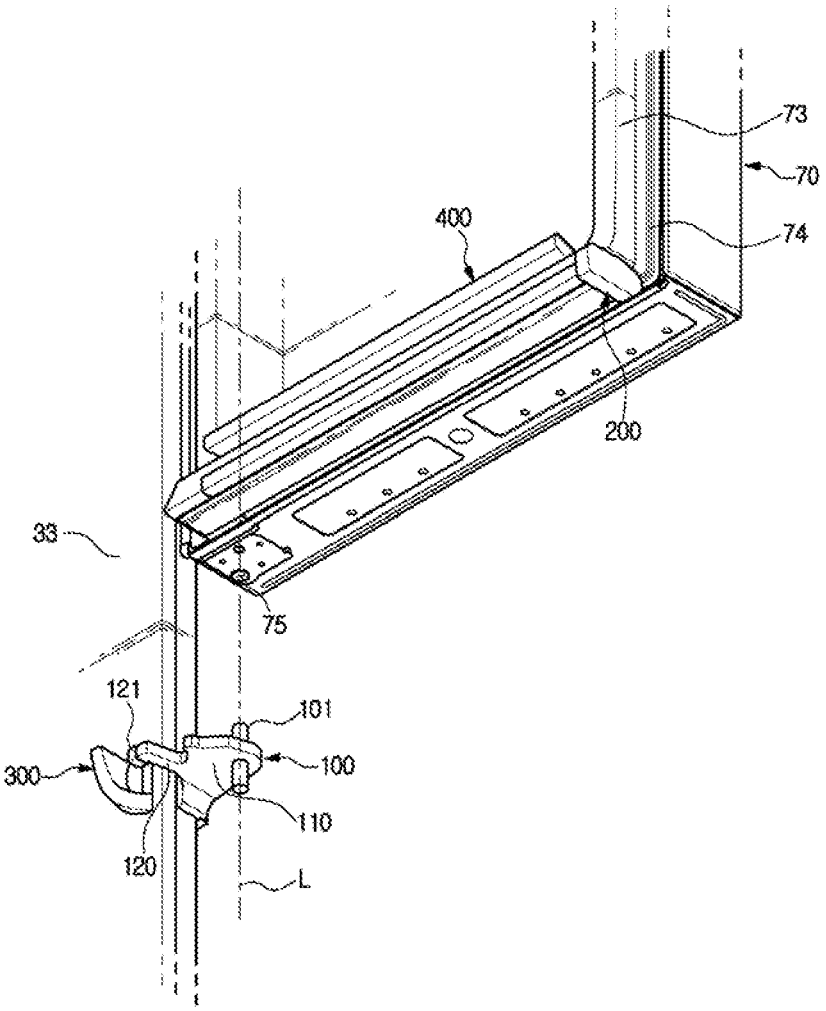
FIG. 2 is a view illustrating an upper door, a hinge, and a filler guide of the refrigerator shown in FIG. 1.

FIG. 2 is a view illustrating the upper door, the hinge, and the filler guide of the refrigerator of FIG. 1.

Referring to FIG. 2, the filler 200 may be coupled to a lower side of the upper door 70. A hinge coupling hole 75 may be provided on a lower surface of the upper door 70, and a hinge shaft 101 of the intermediate hinge 100 may be inserted into the hinge coupling hole 75.

The intermediate hinge 100 includes a hinge body 110, a hinge shaft 101 vertically extending from the hinge body 110, and a filler pusher 120 extending from the hinge body 110 and provided to rotate the filler 200. The hinge shaft 101 is inserted into the hinge coupling hole 75 provided in the upper door 70 and the lower door 80 so as to rotatably support the lower end of the upper door 70 and the upper end of the lower door 80. When the upper door 70 is opened, the filler pusher 120 may push the filler 200 such that the filler 200 rotates. This will be described below.

On a sidewall of the storage compartment 30, a filler guide 300 may be provided to guide the filler 200 to be rotated. The filler guide 300 may be provided adjacent to the intermediate hinge 100. The filler guide 300 may be provided on the sidewall of the storage compartment adjacent to the rotation axis L of the upper door 70 and the lower door 80.

The storage compartment 30 may include a first sidewall 33 and a second sidewall 41. The first sidewall 33 may indicate a sidewall adjacent to the rotation axis L of the door, and the second sidewall 41 may indicate a sidewall facing the first sidewall 33. In other words, the first sidewall 33 may indicate a sidewall adjacent to the intermediate hinge 100 between both sidewalls of the storage compartment 30, and the second sidewall 41 may indicate the other sidewall between the both sidewalls.

The first sidewall 33 may be visible to a user when the doors 70 and 80 are completely opened. On the other hand, the second sidewall 41 may be visible to the user when the doors 70 and 80 start to open. When the filler guide is disposed on the second sidewall 41, the user may see the filler guide whenever the doors 70 and 80 are opened, which may lower the aesthetic quality of the storage compartment.

The user may place foods that are frequently put in or withdrawn in an area adjacent to the second sidewall 41. This is because the area adjacent to the second sidewall 41 is easily accessible even when the doors 70 and 80 are not completely opened. In this case, when the filler guide 200 is installed on the second sidewall 41, the filler guide 200 may interfere with the withdrawing of foods located adjacent to the second sidewall 41. Accordingly, it is preferable to dispose the filler guide on the first sidewall 33 between both sidewalls of the storage compartment 30 in consideration of the aesthetics of the storage compartment and ease of withdrawing or inserting food.

Figure 3:
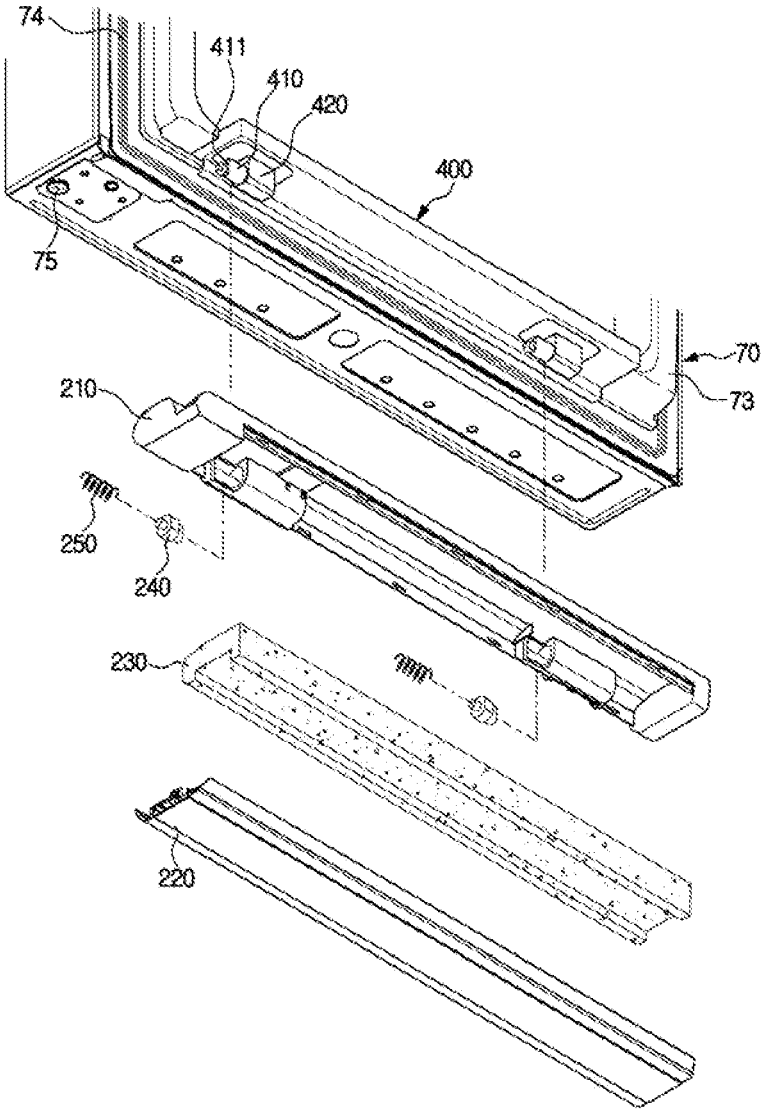
FIG. 3 is an exploded view illustrating a partial area of the upper door and main parts the filler of the refrigerator shown in FIG. 1.
Figure 4:
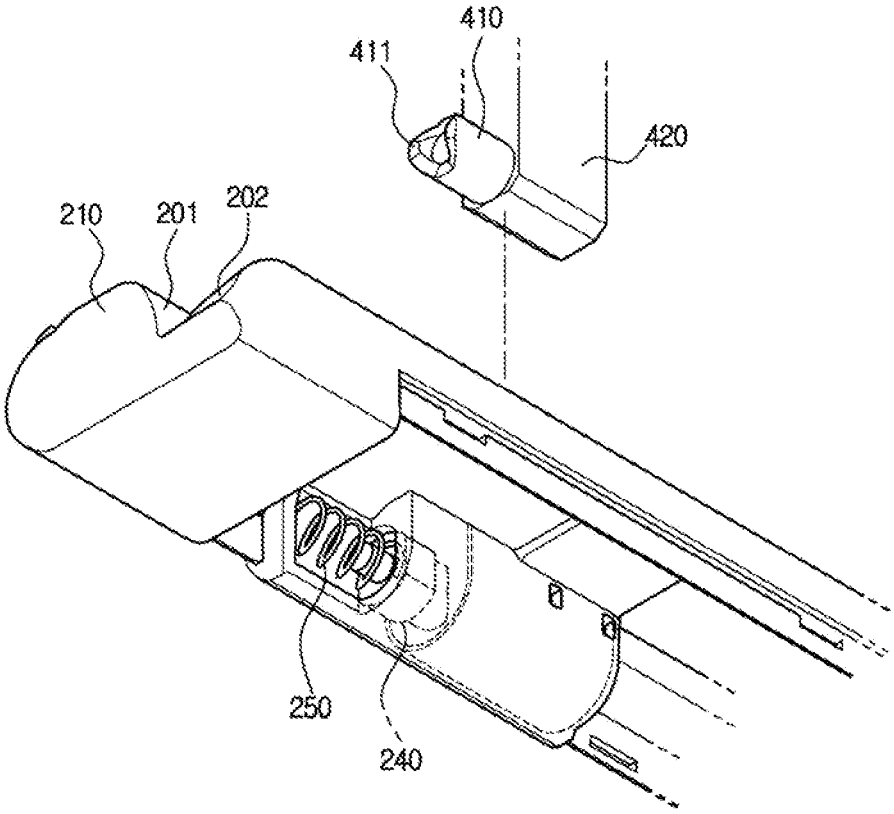
FIG. 4 is an enlarged view illustrating a partial area of the upper door and the filler of the refrigerator shown in FIG. 1.

FIG. 3 is an exploded view illustrating the refrigerator of FIG. 1, which shows a partial area of the upper door and main parts the filler. FIG. 4 is an enlarged view illustrating a partial area of the upper door and the filler of the refrigerator shown in FIG. 1.

Referring to FIGS. 3 and 4, the filler 200 may be rotatably coupled to the lower side of the upper door 70. A filler support 400 may be provided on a rear surface of the upper door 70. A filler shaft 410 serving as a rotation axis of the filler 200 may be provided at a lower side of the filler support 400, and a shaft support 420 connecting the filler shaft 410 to the filler support 400 may be provided on a lower surface of the filler support 400.

The filler 200 includes a first case 210 having a bottom surface thereof open and rotatably coupled to the filler support 400, a second case 220 to cover the open bottom surface of the first case 210, and an insulation 230 disposed inside the first case 210 and the second case 220 to insulate the filler.

A first cam member 240 and a first elastic member 250 providing an elastic force to the first cam member 240 may be provided inside the filler 200. One end of the filler shaft 410 may be connected to the shaft support 420, and the other end 411 of the filler shaft 410 may be provided to correspond to the first cam member 240. That is, the other end 411 of the filler shaft 410 may serve as a second cam member corresponding to the first cam member 240. Hereinafter, the other end 411 of the filler shaft will be referred to as a second cam member.

The first elastic member 250 may provide an elastic force such that the first cam member 240 moves toward the filler shaft 410. One end of the first elastic member 250 may be fixed to one side of the first case 210, and the other end of the first elastic member 250 may be fixed to the first cam member 240. The first elastic member 250 may provide an elastic force to the first cam member 240 in a direction parallel to the rotational axis of the filler 200. The first elastic member 250 may be a compression spring.

Since the filler 200 includes the first cam member 240 and the first elastic member 250, and the other end 411 of the filler shaft is provided corresponding in shape to the shape of the first cam member 240, when the filler 200 rotates by a predetermined angle or more, the filler 200 may be automatically rotated without receiving an additional force. Details thereof will be described below.

Figure 5:
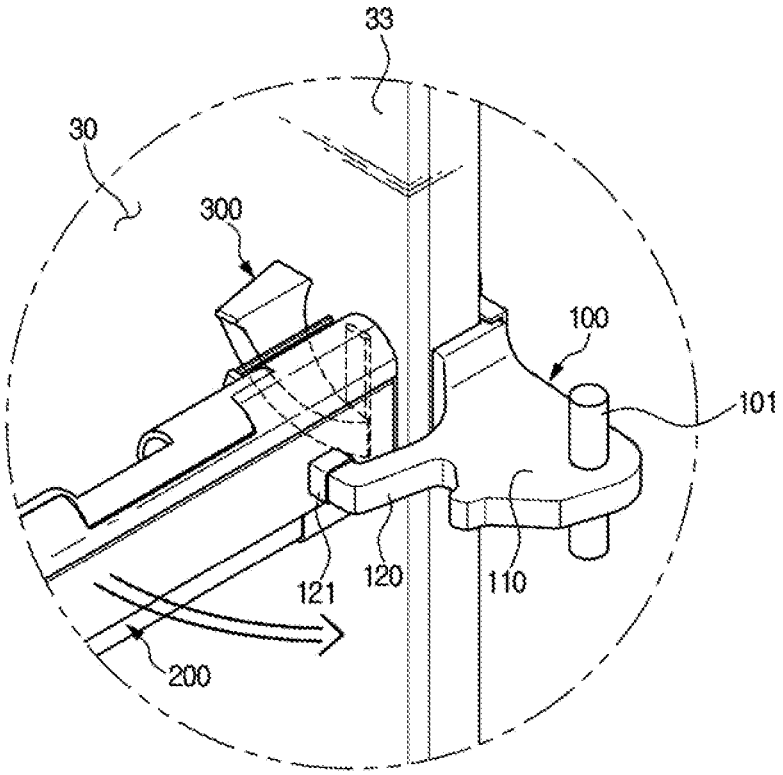
FIG. 5 is an enlarged view illustrating the filler, the filler guide, and the hinge of the refrigerator shown in FIG. 1 when the upper door is closed.
Figure 6:
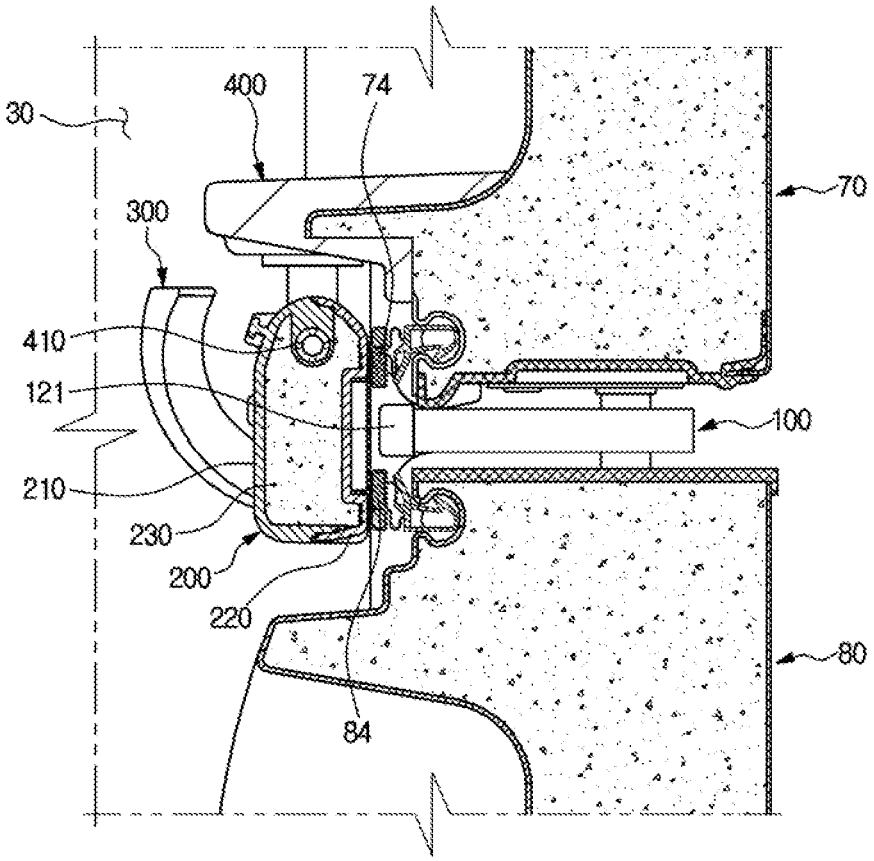
FIGS. 6 and 7 are views illustrating the refrigerator of FIG. 1, which shows a state in which the filler rotates when the upper door is opened.
Figure 7:
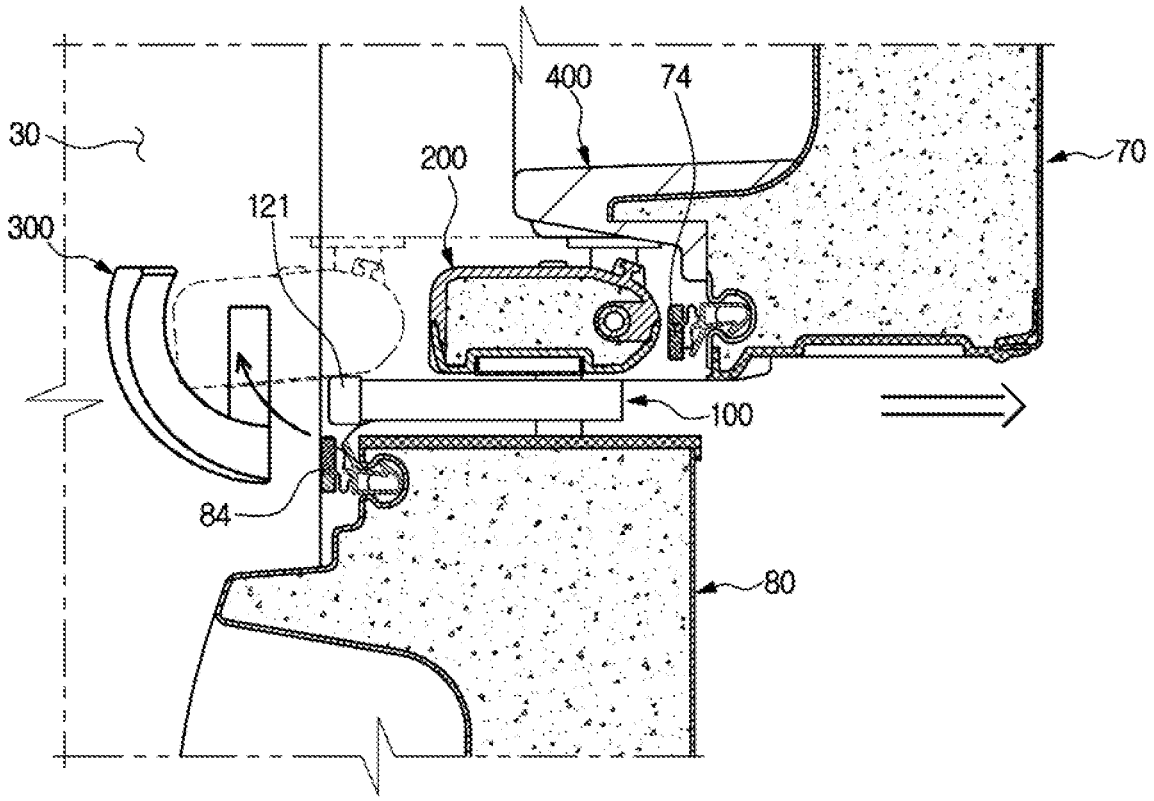

FIG. 5 is an enlarged view illustrating the refrigerator of FIG. 1, which shows the filler, the filler guide, and the hinge when the upper door is closed. FIGS. 6 and 7 are views illustrating the refrigerator of FIG. 1, which shows a state in which the filler rotates when the upper door is opened.

The filler 200 may be located in a first position or a second position. The first position refers to a state in which the filler 200 is arranged to seal a gap between the third door 70 and the fourth door 80. The second position refers to a state in which the filler 200 is arranged so as not to interfere with the opening of the first door 70 or the second door 80 when the first door 70 or the second door 80 is opened. FIG. 5 shows a state in which the filler 200 is located in the first position, and FIG. 6 illustrates a state in which the filler 200 is located in the second position.

The filler 200 may rotate from the first position in the first direction to move to the second position. The filler 200 may rotate from the second position in a second direction opposite to the first direction to move to the first position.

Referring to FIGS. 5 and 6, in a state in which the doors 70 and 80 are closed, the filler 200 may be arranged in a vertical mode to seal the gap between the upper door 70 and the lower door 80.

The filler 200 arranged in the first position comes in contact with the gasket 74 of the upper door 70 and the gasket 84 of the lower door 80 to prevent the cold air inside the storage compartment 30 from leaking to the outside.

In a state in which the upper door 70 is closed, the filler 200 is held in the first position. That is, in a state in which the upper door 70 is closed, the filler 200 does not rotate in the first direction from the first position. This is because the filler guide 300 comes in contact with the filler 200 and prevents the filler 200 from rotating in the first direction.

Referring to FIGS. 5 to 7, when the upper door 70 is opened, the filler 200 may rotate in the first direction and move to the second position. The filler 200 moves together with the upper door 70 and due to a contact with the filler pusher 120, rotates in the first direction. The filler pusher 120 provided to come in contact with the filler 200 may be provided at an end portion thereof with a buffer member 121 to alleviate a shock. The buffer member 121 may be formed of a variety of materials, for example, a rubber material.

As described above, the filler 200 may include the first cam member 240 and the first elastic member 250 to press the first cam member 240 in a direction parallel to the rotation axis of the filler 200, and the other end 411 of the filler shaft 410 may be provided in a shape corresponding to that of the first cam member 240. The first cam member 240 has sections each formed with a different curvature, and the second cam member 411 corresponding to the first cam member 240 may be pressed by the first elastic member 250 to come into contact with the first cam member 240. With such a structure, when the filler 200 coming into contact with the filler pusher 120 is rotated in the first direction by a predetermined angle or more, the filler 200 may be automatically moved to the second position by the elastic force of the first elastic member 250 without further force applied to the filler 200.

When the upper door 70 is opened, the filler pusher 120 may push the filler 200 such that the filler 200 rotates in the first direction by the predetermined angle or more. In another aspect, since the intermediate hinge 100 and the filler pusher 120 extending from the intermediate hinge 100 are fixedly installed, when the filler 200 is moved in association with the opening of the upper door 70, the filler 220 may be rotated in the first direction by the filler pusher 120.

Referring to FIG. 7, after the filler 200 moves to the second position, the filler 200 does not collide with the lower door 80 while the upper door 70 is being opened.

One end of the elastic member 250 may be fixed to one side of the filler 200, and the other end of the elastic member 250 may be fixed to the first cam member 240. The elastic member 250 may provide an elastic force so that the first cam member 240 moves toward the second cam member 411. The first cam member 240 may be maintained in contact with the second cam member 411 by the elastic force of the elastic member 250. The first cam member 240 and the second cam member 411 may allow the filler 200 to be held in the first position once the filler 200 is located in the first position. In the same manner, the first cam member 240 and the second cam member 411 may allow the filler 200 to be held in the second position once the filler 200 is located in the second position.

The filler 200 moved to the second position may be held in the second position because the first cam member 240 and the filler shaft 410 are pressed by the elastic force of the first elastic member 250. The filler 200 may not rotate in the second direction from the second position, and may be held in the second position in a state in which the upper door 70 is open. Unless the filler 200 is not held in the second position, when the upper door 70 in a state of being open is closed, the filler 200 may collide with a front upper side of the lower door 80, which cause the filler 200 to be broken. As described above, according to the embodiment of the disclosure, the filler 200 includes the first elastic member 250 and the first cam member 240 therein, and the second cam member 411 is provided at the other end of the filler shaft 410, so that when the upper door 70 is opened, the filler 200 may be held in the second position, thereby preventing the above-described limitation.

Meanwhile, when the upper door 70 is opened, the filler 200 moves forward from the storage compartment 30 together with the upper door 70. As the filler 200 moves forward from the storage compartment 30, the filler 200 becomes distant away from the filler guide 300. As the filler 200 having been restricted from rotating in the first direction under contact with the filler guide 300 is no more in contact with the filler guide 300, the filler 220 is not interfered with the filler guide 300 in rotating. Accordingly, the filler 200 is capable of rotating in the first direction. When the upper door 70 is opened, the filler pusher 120 pushes the filler 200 so that the filler 200 may rotate in the first direction.

Figure 8:
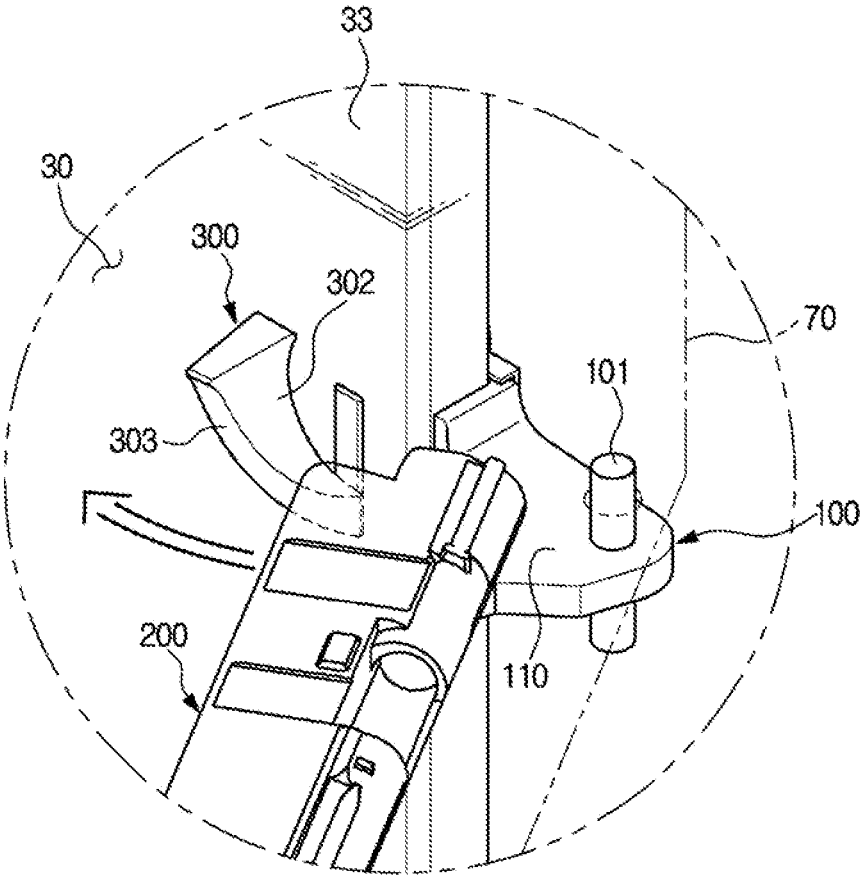
FIGS. 8 to 10 are views illustrating the refrigerator of FIG. 1, which shows a state in which the filler rotates when the door is closed.
Figure 9:
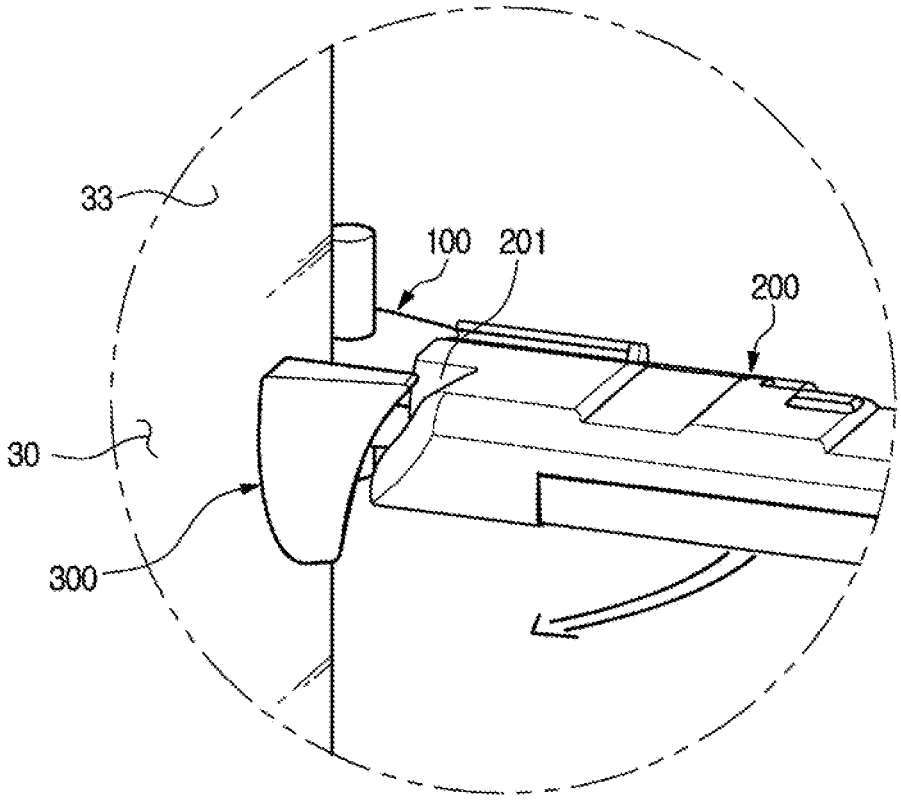
Figure 10:
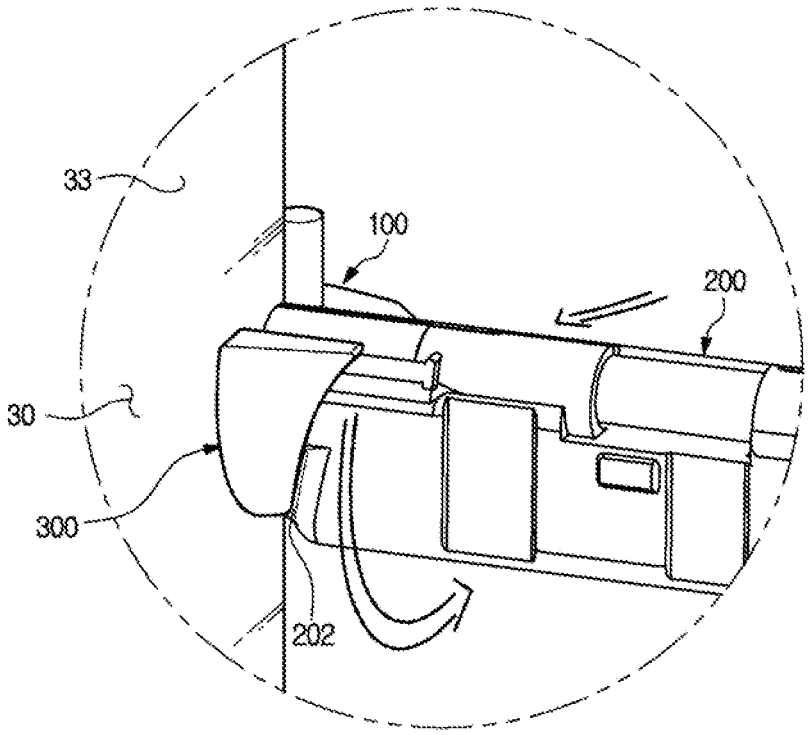
Figure 11:
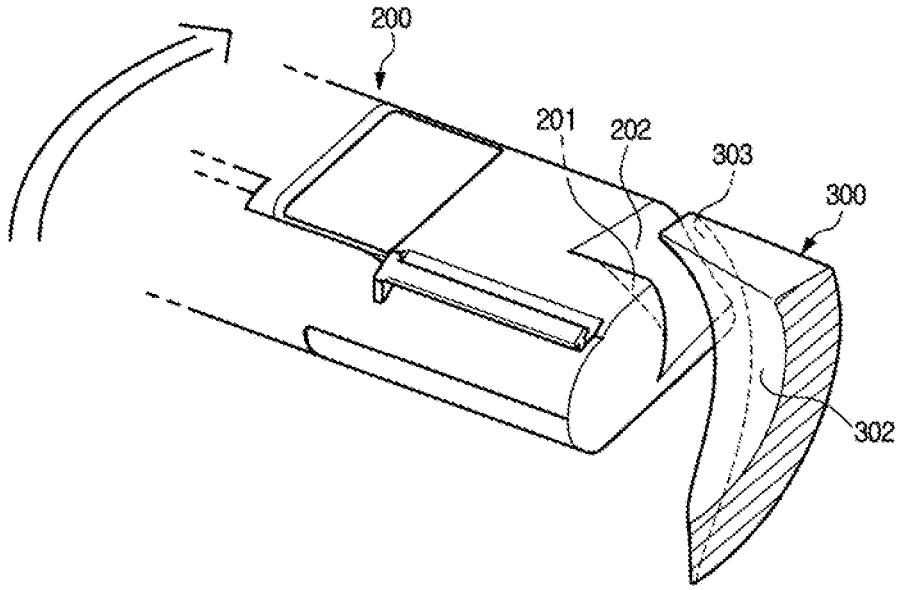
FIGS. 11 to 13 are views illustrating the refrigerator of FIG. 1, which shows operations of the filler and the filler guide according to door opening and closing.
Figure 12:
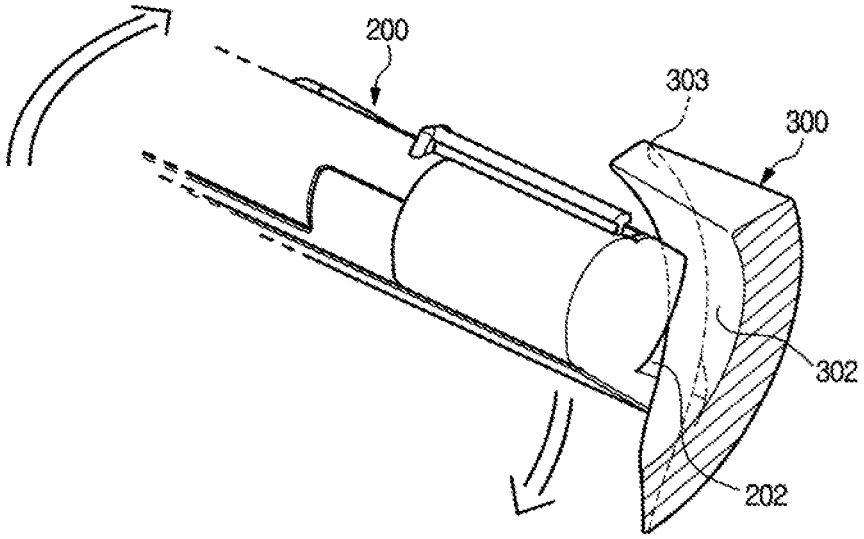
Figure 13:
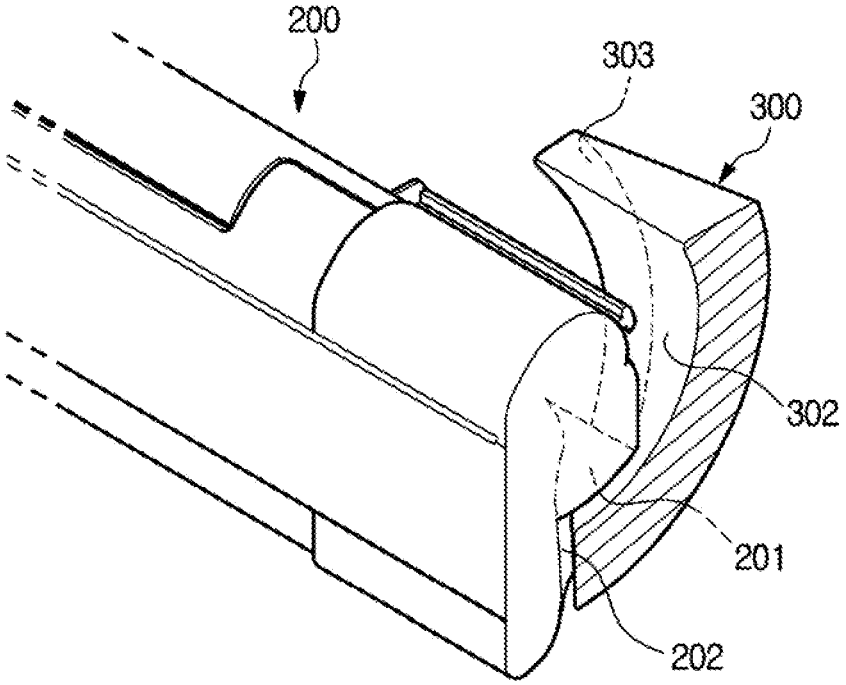

FIGS. 8 to 10 are views illustrating the refrigerator of FIG. 1, which shows a state in which the filler rotates when the door is opened. FIGS. 11 to 13 are views illustrating the refrigerator of FIG. 1, which shows operations of the filler and the filler guide according to door opening and closing.

An operation of rotating the filler 200 when the upper door 70 is closed will be described in detail with reference to FIGS. 8 to 13.

As described above, when the upper door 70 is opened, the filler 200 may be held in the second position. When the upper door 70 is closed, the filler 200 may rotate in the second direction to move from the second position to the first position.

Referring to FIGS. 8 to 13, the filler 200 is provided at one side thereof with a first sliding surface 201 and a second sliding surface 202 configured to be in contact with the filler 300. The filler guide 300 may include a first guide surface 302 provided to guide the first sliding surface 201 and a second guide surface 303 provided to guide the second sliding surface 202.

While the upper door 70 is being closed, the first sliding surface 201 may be guided along the second guide surface 302. Further, the second sliding surface 202 may be guided along the second guide surface 303. When the first sliding surface 201 and the second sliding surface 202 are guided along the first guide surface 302 and the second guide surface 303, respectively, the filler 200 may be moved from the second position to the first position. That is, the filler 200 may be guided to rotate in the second direction. Each of the first sliding surface 201, the second sliding surface 202, the first guide surface 302, and the second guide surface 303 may have a curved shape. Accordingly, the filler 200 may be guided smoothly by the filler guide 300.

When the upper door 70 is in a closed state, the first sliding surface 201 and the first guide surface 302 may be maintained in contact with each other. Similarly, when the upper door 70 is in a closed state, the second sliding surface 202 and the second guide surface 303 may be maintained in contact with each other. The filler guide 300 may be installed to be fixed to the first sidewall 33 of the storage compartment 30. Since the filler guide 300 is maintained in a fixed state, when the first sliding surface 201 and the second sliding surface 202 are in contact with the first guide surface 302 and the second guide surface 303, respectively, the filler 200 may be prevented from rotating in the first direction. That is, the filler guide 300 may prevent the filler 200 from rotating in the first direction when the upper door 70 is in a closed state.

As described above, the filler 200 may include the first cam member 240, and the filler shaft 410 may include the second cam member 411. The elastic member 250 may provide an elastic force to maintain the first cam member 240 and the second cam member 411 in a state of being engaged with each other. The first cam member 240 and the second cam member 411 may be provided to be engaged with each other when the filler 200 is in the first position or the second position. When the filler 200 in the first position receives a force greater than or equal to the elastic force, the first cam member 240 and the second cam member 411 are displaced, and the filler 200 may be moved to the second position. Once the filler 200 is moved to the second position, the first cam member 240 and the second cam member 411 may be maintained engaged with each other similar to the case when the filler 200 is in the first position. Accordingly, the first cam member 240 and the second cam member 411 may allow the filler 200 to be held in the first position or the second position. In other words, the first cam member 240 and the second cam member 411 may prevent the filler 200 from rotating in the first direction or in the second direction. However, when the filler 220 receives a force greater than or equal to the elastic force of the elastic member 250 as described above, the filler 200 may be rotated in the first direction or the second direction despite the first cam member 240 and the second cam member 411.

In this case, when a force greater than or equal to the elastic force is applied, the first cam member 240 and the second cam member 411 are not engaged with each other, When the filler 200 receives a predetermined force or more to rotate in the first direction, the first cam member 240 and the second cam member 411

As described above, when the upper door 70 is closed, the filler guide 300 may guide the filler 200 to be rotated in the second direction. In addition, the filler guide 300, when the upper door 70 is closed.

Figure 14:
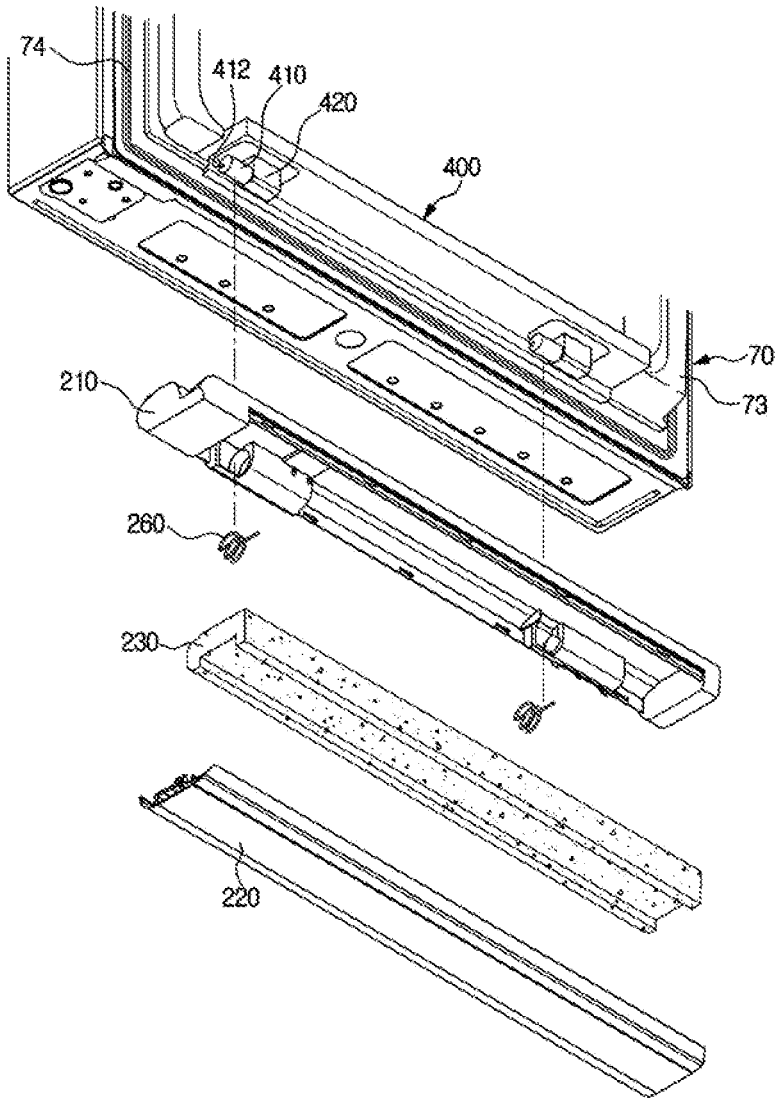
FIG. 14 is an exploded view illustrating a refrigerator according to another embodiment of the disclosure, which shows a partial area of a door and main parts of a filler of the refrigerator.
Figure 15:
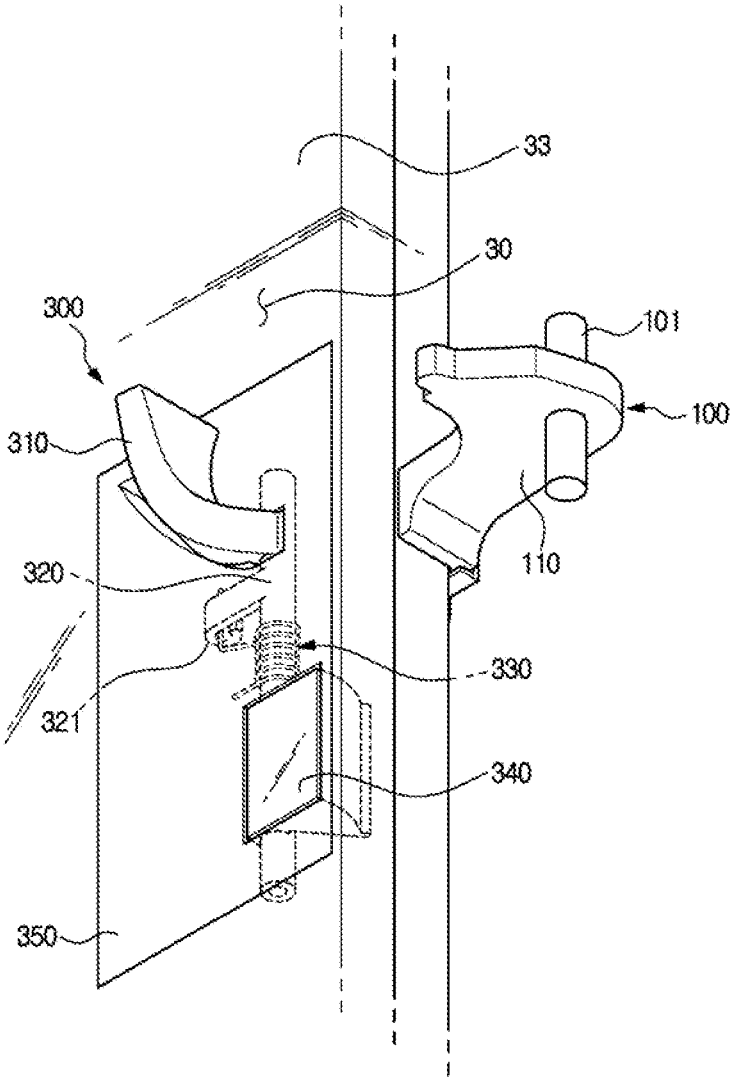
FIG. 15 is an enlarged view illustrating a filler guide and a hinge of the refrigerator shown in FIG. 14.

FIG. 14 is an exploded view illustrating a refrigerator according to another embodiment of the disclosure, which shows a partial area of a door and main parts of a filler of the refrigerator. FIG. 15 is an enlarged view illustrating a filler guide and a hinge of the refrigerator shown in FIG. 14.

According to the embodiment of the disclosure, the filler 200 may include a second elastic member 260 that provides an elastic force so that the filler 200 rotates in the first direction.

The filler shaft 410 may include a first insertion groove 412 into which at least a portion of the second elastic member 260 is inserted. The first insertion groove 412 may be provided on one surface of the filler shaft 410.

One end of the second elastic member 260 may be inserted into the first insertion groove 412 provided on the filler shaft 410, and the other end of the second elastic member 260 may be inserted into a space formed between the first case 210 and the heat insulating material 230. The second elastic member 260 may provide an elastic force so that the filler 200 rotates in the first direction, and to this end, the second elastic member 260 may be provided using a torsion spring.

According to the embodiment of the disclosure, since the filler 200 include the second elastic member 260, the filler 220 may receive an elastic force to be rotated in the first direction. In other words, the second elastic member 260 may elastically bias the filler 200 to be rotated in the first direction.

The filler 200 is subject to continuous elasticity by the second elastic member 260 to be rotated from the first position in the first direction. However, when the upper door 70 is in a closed state, the filler 200 is prevented from being rotated in the first direction by the filler guide 300. In contrast, when the upper door 70 is opened, the filler 200 may be rotated in the first direction by the elastic force of the second elastic member 260 without being into contact the filler pusher 120 of the intermediate hinge 100. That is, in the embodiment of the disclosure, referring to FIG. 11, the filler pusher (120 in FIG. 4) may be omitted, and the filler 200 may be rotated from the first position in the first direction to the second position. In addition, by the elastic force of the second elastic member 260, the filler 200 may be held in the second position when the upper door 70 is opened.

Referring to FIG. 15, in the refrigerator according to the embodiment of the disclosure, the intermediate hinge 100 may include the hinge body 110 and the hinge shaft 101 vertically extending from the hinge body 110. As described above, the filler pusher may be omitted. However, the disclosure is not limited thereto, and the intermediate hinge may include a filler pusher.

The filler guide 300 may include a guide portion 310 configured to come in contact with the filler 200 to guide the filler 200 to be rotated in the first direction, a shaft portion 320 extending from the guide portion 310 to form a rotation axis of the guide portion 310, a third elastic member 330 providing an elastic force to the shaft portion 320, and a switch portion 340 configured to be withdrawn from or inserted into according to the opening and closing of the lower door 80.

The sidewall 33 of the storage compartment 30 may be formed with an accommodation space 301 in which the filler guide 300 is accommodated. The accommodating space 301 may accommodate the shaft portion 320, an elastic member fixing portion 321 extending from the shaft portion 320 and allowing one end of the third elastic member 330 to be fixed thereto, and the third elastic member 330. In addition, the guide portion 310 and the switch portion 340 may be selectively arranged in the accommodation space 301 according to the opening and closing of the lower door 80. The filler guide 300 may further include a cover plate 350 covering the accommodation space 301.

With such a structure, the refrigerator according to the embodiment of the disclosure may allow the filler 200 to move from the first position to the second position even when only the lower door 80 is opened with the upper door 70 closed. This will be described in detail with reference to FIGS. 16 to 16.

Figure 16:
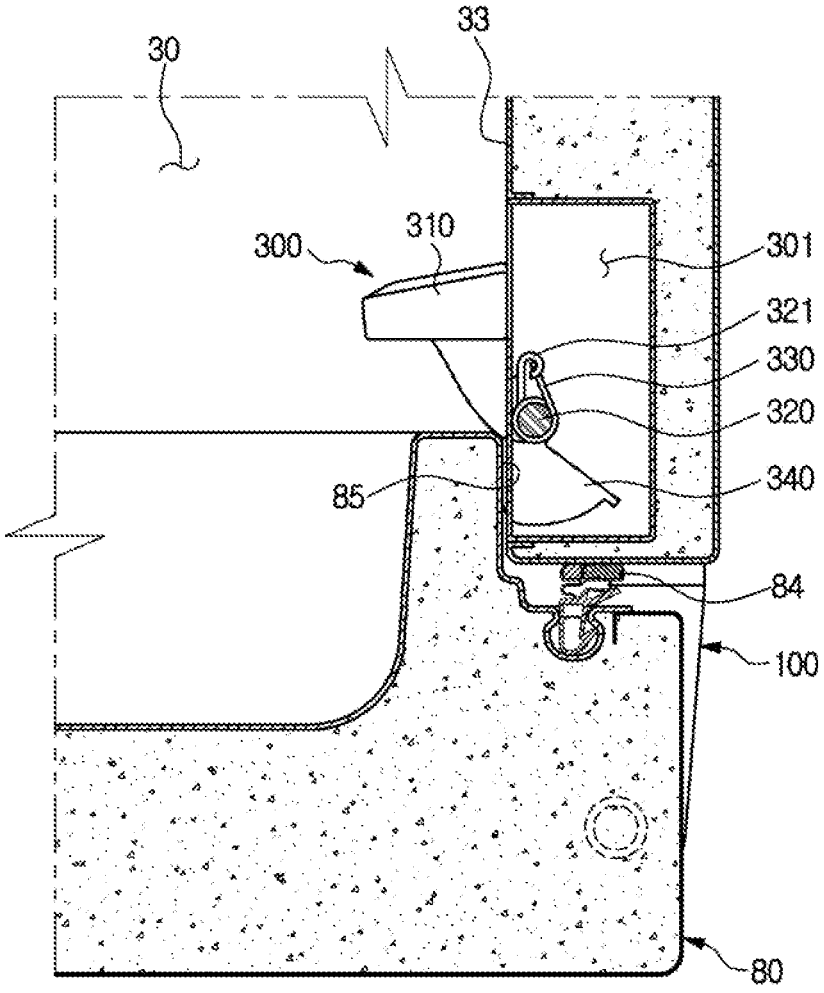
FIG. 16 is a cross-sectional plan view of the refrigerator shown in FIG. 14, which shows the filler guide when a lower door is in a closed state.
Figure 17:
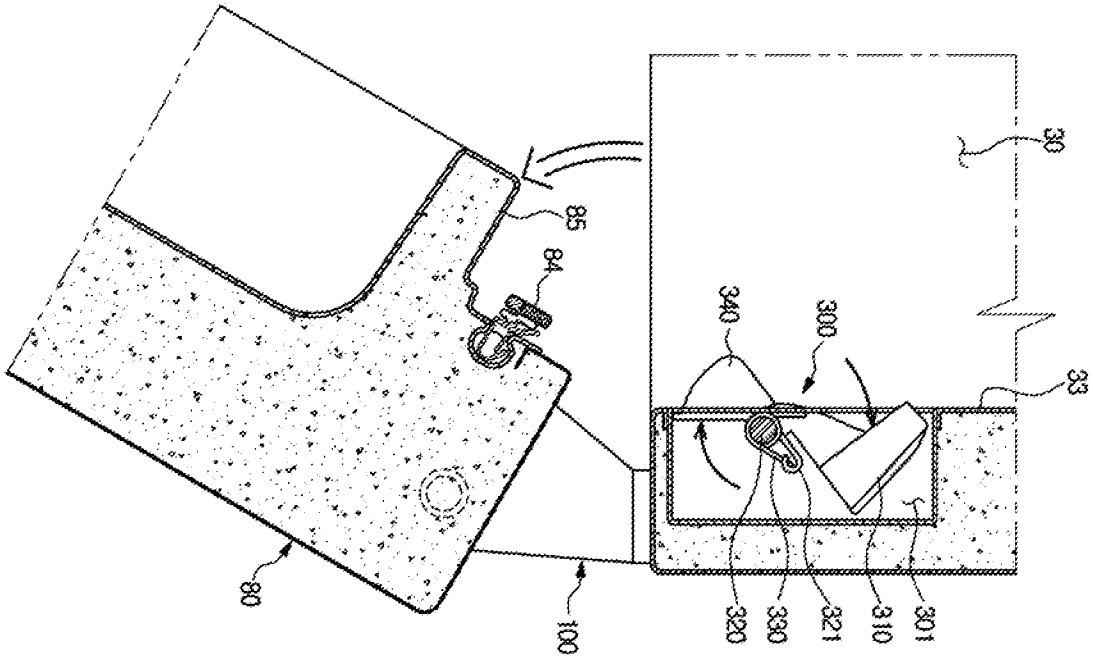
FIG. 17 is a cross-sectional plan view of the refrigerator shown in FIG. 14, which shows the filler guide when the lower door is in an open state.
Figure 18:
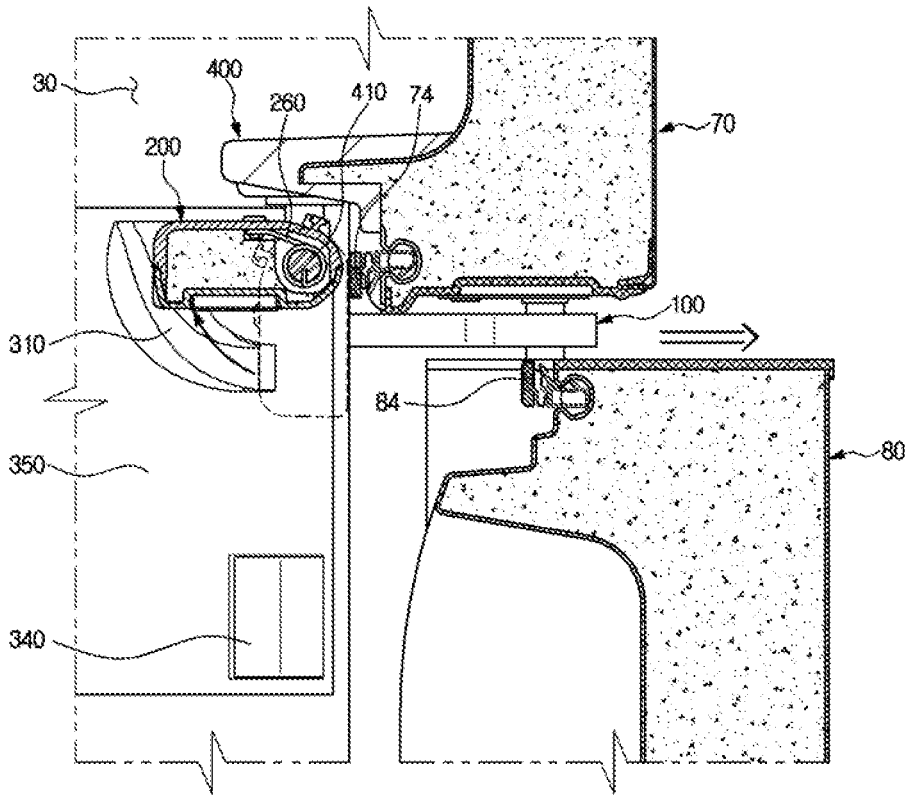
FIG. 18 is a side cross-sectional view of the refrigerator shown in FIG. 14, which shows operations of the filler guide and the filler according to opening and closing of the lower door.

FIG. 16 is a cross-sectional plan view of the refrigerator shown in FIG. 14, which shows the filler guide when a lower door is in a closed state. FIG. 17 is a cross-sectional plan view of the refrigerator shown in FIG. 14, which shows the filler guide when the lower door is in an open state. FIG. 18 is a side cross-sectional view of the refrigerator shown in FIG. 14, which shows operations of the filler guide and the filler according to opening and closing of the lower door.

Referring to FIG. 16, when the lower door 80 is in a closed state, one surface 85 of the lower door 80 facing the filler guide 300 may be provided to come in contact with the switch portion 340.

The third elastic member 330 is provided to provide an elastic force to the shaft portion 320 such that the shaft portion 320 rotates clockwise in the drawing. To this end, the third elastic member 330 may include a torsion spring. When the one surface 85 of the lower door 80 presses the switch portion 340 with a force greater than or equal to the elastic force of the third elastic member 330, the shaft portion 320, the guide portion 310 extending from the shaft portion 320, and the switch portion 340 are rotated counterclockwise. That is, in FIG. 16, the third elastic member 330 is in a state of having an elastic force accumulated state.

When the switch portion 340 is pressed by the lower door 80 and disposed inside the accommodation space 301, the guide portion 310 may protrude to the outside of the accommodation space 301. The guide portion 310 may protrude to the outside of the accommodating space 310, that is, to the inside of the storage compartment 30, to prevent the filler 200 from rotating in the first direction when the upper door 70 is closed.

Referring to FIGS. 17 and 18, when the lower door 80 is opened, the one surface 85 of the lower door 80 may be separated from the switch portion 340, and the switch portion 340 may be rotated clockwise by the elastic force of the third elastic member 330.

Since the switch portion 340, the shaft portion 320, and the guide portion 310 are integrally formed with each other, when the switch portion 340 rotates in a clockwise direction, the guide portion 310 also rotates in a clockwise direction. When the guide portion 310 rotates clockwise, the guide portion 310 may be caused to be disposed inside the accommodation space 301. That is, as the lower door 80 is opened, the guide portion 310 may be caused to be disposed inside the accommodation space 301. In this case, since the guide portion 310, which has prevented the filler 200 from being rotated in the first direction, moves to the inside of the accommodation space 301, the guide portion 310 may not operate to prevent the filler 200 from being rotated. Accordingly, the filler 200 may rotate in the first direction to move from the first position to the second position. According to the embodiment of the disclosure, even when only the lower door 80 is opened while the upper door 70 is closed, the filler 200 is arranged in a horizontal mode, so that the filler 200 does not interfere with withdrawing of food inside the storage compartment 30. Accordingly, food may be easily withdrawn from the storage compartment 30.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

The invention claimed is:

1. A refrigerator comprising:

a main body;

a storage compartment formed in the main body and having a front side thereof open;

a first door rotatably coupled to the main body to open and close a part of the storage compartment;

a second door arranged below the first door and rotatably coupled to the main body to open and close a remaining part of the storage compartment;

a hinge arranged between the first door and the second door and configured to rotatably support each of a lower end of the first door and an upper end of the second door;

a filler rotatably provided on the first door or the second door to seal a gap between the first door and the second door in a state in which the first door and the second door are closed;

a filler guide configured to guide the filler to be rotated in a first direction, and disposed on a sidewall of the storage compartment adjacent to a rotation axis of the first door and the second door; and a filler pusher extending from the hinge and configured to push the filler to be rotated in a second direction opposite to the first direction, the filler pusher being disposed between the lower end of the first door and the upper end of the second door when the first door and the second door are closed.

2. The refrigerator of claim 1, wherein the filler guide is configured to guide the filler when the first door or the second door is opened, and the filler pusher is configured to contact the filler when the first door or the second door is closed, and to be spaced apart from the filler when the first door or the second door is open.

3. The refrigerator of claim 1, wherein in a state in which the first door or the second door is closed, the filler guide is configured to contact the filler to prevent the filler from rotating in the first direction.

4. The refrigerator of claim 1, wherein the filler includes a first sliding surface formed at a side end thereof and a second sliding surface adjacent to the first sliding surface.

5. The refrigerator of claim 4, wherein the filler guide includes a first guide surface and a second guide surface configured to guide the first sliding surface and the second sliding surface, respectively, when the first door or the second door is closed.

6. The refrigerator of claim 5, wherein the first sliding surface, the second sliding surface, the first guide surface, and the second guide surface each have a curved shape.

7. The refrigerator of claim 1, further comprising:

a first cam member arranged on a rotation axis of the filler;

a second cam member provided on the first door or the second door to correspond to the first cam member; and an elastic member configured to provide the first cam member or the second cam member with an elastic force such that the first cam member comes in contact with the second cam member.

8. The refrigerator of claim 7, wherein the filler is rotated in the first direction or the second direction in response to receiving a force exceeding the elastic force.

9. The refrigerator of claim 3, wherein the filler guide is configured to, when the first door and the second door are closed, be located in a first position where the filler is prevented from rotating in the first direction, and when the first door or the second door, which is provided with the filler, is opened, be moved to a second position different from the first position where the filler is allowed to rotate in the first direction.

10. The refrigerator of claim 9, wherein the filler guide includes a guide portion configured to guide the filler, and a switch portion configured to protrude inward of the storage compartment alone or together with the guide portion.

11. The refrigerator of claim 10, wherein the filler guide further includes:

a shaft portion connected to the guide portion and the switch portion, and forming a rotating center of the guide portion and the switch portion; and an elastic member configured to elastically bias the shaft portion to be rotated in a predetermined direction.

12. The refrigerator of claim 1, wherein the storage compartment includes a first storage compartment and a second storage compartment laterally divided by a vertical partition.

* * * * *